US009951627B2

(12) United States Patent
Yagi et al.

(10) Patent No.: US 9,951,627 B2
(45) Date of Patent: Apr. 24, 2018

(54) IMPELLER AND ROTATING MACHINE PROVIDED WITH SAME

(71) Applicants: MITSUBISHI HEAVY INDUSTRIES COMPRESSOR CORPORATION, Tokyo (JP); MITSUBISHI HEAVY INDUSTRIES, LTD., Tokyo (JP)

(72) Inventors: Nobuyori Yagi, Tokyo (JP); Daisuke Hirata, Hiroshima (JP)

(73) Assignees: MITSUBISHI HEAVY INDUSTRIES COMPRESSOR CORPORATION, Tokyo (JP); MITSUBISHI HEAVY INDUSTRIES, LTD., Tokyo (JP)

( * ) Notice: Subject to any disclaimer, the term of this patent is extended or adjusted under 35 U.S.C. 154(b) by 424 days.

(21) Appl. No.: 14/369,814

(22) PCT Filed: Feb. 8, 2013

(86) PCT No.: PCT/JP2013/053044
§ 371 (c)(1),
(2) Date: Jun. 30, 2014

(87) PCT Pub. No.: WO2013/122000
PCT Pub. Date: Aug. 22, 2013

(65) Prior Publication Data

US 2014/0356179 A1 Dec. 4, 2014

(30) Foreign Application Priority Data

Feb. 13, 2012 (JP) ..... 2012-028763

(51) Int. Cl.
*F01D 25/00* (2006.01)
*F01D 5/14* (2006.01)
(Continued)

(52) U.S. Cl.
CPC ..... *F01D 5/141* (2013.01); *F01D 5/025* (2013.01); *F04D 17/12* (2013.01); *F04D 29/266* (2013.01); *F04D 29/284* (2013.01)

(58) Field of Classification Search
CPC ..... F04D 17/12; F04D 29/266; F04D 29/284; F01D 5/025; F01D 5/141
(Continued)

(56) References Cited

U.S. PATENT DOCUMENTS 2,441,432 A 5/1948 McGee
2,799,445 A * 7/1957 Hull ..... F01D 5/025 384/416
(Continued)

FOREIGN PATENT DOCUMENTS

CN 1302356 7/2001
CN 1737378 2/2006
(Continued)

OTHER PUBLICATIONS

Chinese Office Action dated Sep. 1, 2015 in corresponding Chinese Patent Application No. 201380003984.2 with partial English translation.
(Continued)

*Primary Examiner* — Jason Shanske
*Assistant Examiner* — Jason Mikus
(74) *Attorney, Agent, or Firm* — Wenderoth, Lind & Ponack, L.L.P.

(57) ABSTRACT

The impeller is provided with: a disc section equipped with a tube section, the grip section of which is fixed by thermal deformation to a rotation shaft that is rotated around the axis line, and a main disc body, which is provided on the other end in the axial direction from the grip section and which extends outward in the radial direction of the rotation shaft; and blade sections that protrude from the main disc body in
(Continued)

the axial direction. The disc section is provided with a hoop stress-limiting section, the tube section of which extends further towards the other end in the axial direction than the main disc body.

5 Claims, 14 Drawing Sheets

(51) Int. Cl.

| | |
|---|---|
| ***F04D 17/12*** | (2006.01) |
| ***F04D 29/26*** | (2006.01) |
| ***F04D 29/28*** | (2006.01) |
| ***F01D 5/02*** | (2006.01) |

(58) Field of Classification Search
USPC ..... 416/244 A
See application file for complete search history.

(56) References Cited

U.S. PATENT DOCUMENTS

| | | | | |
|---|---|---|---|---|
| 4,697,987 | A | 10/1987 | Katayama et al. | |
| 6,012,901 | A * | 1/2000 | Battig | F01D 5/025 416/244 A |
| 7,008,191 | B2 * | 3/2006 | Billington | F04D 29/266 416/204 A |

FOREIGN PATENT DOCUMENTS

| | | | |
|---|---|---|---|
| DE | 41 41 427 | | 6/1993 |
| DE | 44 45 297 | | 3/1996 |
| DE | 197 36 333 | | 3/1999 |
| GB | 219655 | | 10/1924 |
| GB | 1 554 568 | | 10/1979 |
| JP | 58-190598 | | 11/1983 |
| JP | 58-220901 | | 12/1983 |
| JP | 60-26197 | | 2/1985 |
| JP | 6026197 | A1 * | 2/1985 |
| JP | 61-142393 | | 6/1986 |
| JP | 61-212601 | | 9/1986 |
| JP | 10-212967 | | 8/1998 |
| JP | 2003-293988 | | 10/2003 |
| JP | 2005-002849 | | 1/2005 |
| JP | 2009-228774 | | 10/2009 |
| JP | 2011-085088 | | 4/2011 |
| JP | 2011085088 | A1 * | 4/2011 |
| WO | 2012/077422 | | 6/2012 |
| WO | 2013/087496 | | 6/2013 |

OTHER PUBLICATIONS

Extended European Search Report dated Oct. 20, 2015 in corresponding European Patent Application No. 13749725.1.
Extended European Search Report dated Oct. 20, 2015 in corresponding European Patent Application No. 15161331.2.
International Search Report dated May 7, 2013 in International Application No. PCT/JP2013/053044 with English Translation.
Written Opinion of the International Searching Authority dated May 7, 2013 in International Application No. PCT/JP2013/053044 with English Translation.
Office Action dated Feb. 10, 2017 in U.S. Appl. No. 14/671,081.

* cited by examiner

IMPELLER AND ROTATING MACHINE PROVIDED WITH SAME

TECHNICAL FIELD

The present invention relates to an impeller and a rotating machine having a rotary shaft to which the impeller is fixed.

Priority is claimed on Japanese Patent Application No. 2012-028763, filed Feb. 13, 2012, the content of which is incorporated herein by reference.

BACKGROUND ART

In a turbo freezing machine, a small gas turbine, or the like, a rotating machine such as a centrifugal compressor or the like is used. The rotating machine has an impeller having a disk section fixed to a rotary shaft and at which a plurality of blades are installed. As the impeller is rotated, pressure energy and velocity energy are applied to a gas.

In the impeller, when the rotary shaft is rapidly rotated, a tensile stress in the vicinity of an inner circumferential surface of a mounting hole of the impeller may increase and cause damage to the impeller. In order to prevent damage to the impeller, in Patent Literature 1, a technology for reducing the tensile stress is disclosed. The impeller of Patent Literature 1 has the mounting hole passing through a central section of the impeller. The rotary shaft is inserted into the mounting hole by fitting using a slight clearance fit or an interference fit throughout the entire inner circumferential surface. Then, a stress reduction recess configured to reduce the tensile stress is formed at the inner circumferential surface of the mounting hole.

CITATION LIST

Patent Literature

[Patent Literature 1] Japanese Unexamined Patent Application, First Publication No. 2005-002849

SUMMARY OF INVENTION

Problem to be Solved by the Invention

FIG. 14 is a contour diagram showing a simulation result of a stress applied to an impeller 610 upon high speed rotation. The impeller 610 is a so-called open type impeller constituted by a disk section 30 and a blade section 40. Referring to FIG. 15, the disk section 30 includes a tube section 32 to which a grip section (a left section in FIG. 15) 33 of a front side in an axis O direction of the rotary shaft 5 is fixed with respect to a rotary shaft 5 by shrinkage fitting or the like, and a disk main body section 35 installed at a position closer to a rear side in the axis O direction than the grip section 33 and extending outward in a radial direction of the rotary shaft 5. In the impeller 610 formed as described above, a point at which the stress applied upon the high speed rotation of the rotary shaft 5 becomes a maximum (a stress concentration point) is in the vicinity of a corner at the rear side in the axis O direction opposite to the grip section 33. This is because the corner of the disk section 30 is to be displaced outward in the radial direction shown by a dotted line of FIG. 15 by a load in a thrust direction (a thrust force) or the like due to a centrifugal force upon rotation or a gas pressure difference between a flow path side and a rear surface side of the disk. The stress concentration in the vicinity of the corner is mainly constituted by a hoop stress serving as a tensile stress applied in a circumferential direction of the impeller 610. In addition, in FIG. 15, a point at which the hoop stress is concentrated is referred to by reference numeral "f."

Since a magnitude of the hoop stress in the vicinity of the corner of the disk section 30 is increased as a rotational speed is increased, for example, when the rotational speed is unintentionally increased, strength of the disk section 30 may become insufficient. In order to prevent the insufficient strength, for example, a method of fixing the tube section 32 to an outer circumferential surface of the rotary shaft 5 throughout the entire inner circumferential surface of the tube section 32 is considered. Further, a method of fixing the tube section 32 to the outer circumferential surface of the rotary shaft 5 at a plurality of points like Patent Literature 1 is also considered. However, when the impeller 610 is removed from the rotary shaft 5, or the like, an increase in temperature throughout a wide range of the disk section 30 is needed, and ease of assembly and maintenance deteriorate.

In consideration of the above-mentioned circumstances, the present invention provides an impeller and a rotating machine provided with the same that are capable of easy attachment and detachment with respect to a rotary shaft and prevention of local concentration of stress upon rotation.

Means for Solving the Problem

In order to solve the above-mentioned problems, the following configurations are employed.

An impeller according to a first aspect of the present invention includes a tube section having a substantially tube shape, into which a rotary shaft rotated around an axis is inserted, and provided with a grip section installed at one side in an axial direction of the rotary shaft and fixed to the rotary shaft; a disk main body section formed closer to the other side in the axial direction than the grip section and extending from the tube section toward the outside in the radial direction of the rotary shaft; a disk section including the tube section and the disk main body section; and a blade section protruding from the disk main body section to the one side in the axial direction, wherein the disk section includes a hoop stress suppression section extending from the tube section to be closer to the other side in the axial direction than the disk main body section.

In this way, by only fixing the grip section of the one side in the axial direction, easy attachment and detachment with respect to the rotary shaft can be performed. Meanwhile, in the other side in the axial direction not fixed to the rotary shaft, as stiffness of deformation in the radial direction by the centrifugal force is increased by the hoop stress suppression section extending to the other side in the axial direction, the impeller can be suppressed from being deformed to float in the radial direction at the other side in the axial direction. Accordingly, an increase in hoop stress generated by deformation in the radial direction can be suppressed.

In the impeller, the tube section may include a first axial direction stress displacement groove and a second axial direction stress displacement groove formed on an inner circumferential surface of the tube section or the hoop stress suppression section at both sides in the axial direction of a position at which a hoop stress is concentrated, and configured to displace a position at which an axial direction stress applied to the disk section is concentrated toward the outside in the radial direction from the position at which the hoop stress is concentrated.

As a result, the point at which the axial direction stress is concentrated can be displaced to the outside in the radial direction farther than the first axial direction stress displacement groove and the second axial direction stress displacement groove. Accordingly, since the point at which the axial direction stress is concentrated and the point at which the hoop stress is concentrated can be separated in the radial direction, stress concentration in the disk section can be reduced.

In the impeller, the disk section may include the hoop stress suppression section as a separate member.

As a result, since a material having a higher Young's modulus than the disk section can be employed as a material of the hoop stress suppression section, it is more difficult to be deformed the hoop stress suppression section.

In the impeller, a rib may be provided throughout the other surface in the axial direction of the disk main body section and the hoop stress suppression section.

According to the above-mentioned configuration, stiffness of a rear surface of the disk section can be improved while suppressing an increase in weight of a rear surface of the disk main body section.

A rotating machine according to a second aspect of the present invention includes the impeller described above.

According to the above-mentioned configuration, maintenance of the impeller can be improved. Further, since damage to the impeller upon rotation can be prevented, reliability can be improved.

Advantageous Effects of Invention

According to the present invention, easy attachment and detachment with respect to the rotary shaft and prevention of local concentration of a stress upon rotation become possible.

DESCRIPTION OF EMBODIMENTS

A rotating machine and an impeller according to a first embodiment of the present invention will be described with reference to the accompanying drawings.

Figure 1:
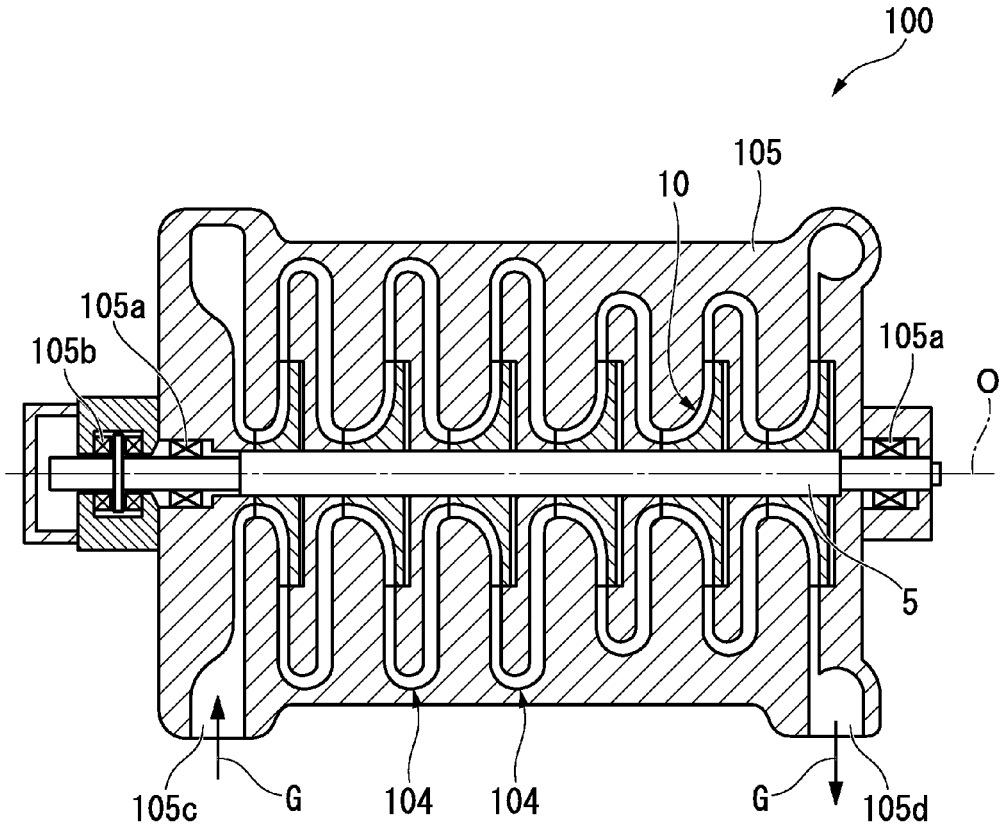
FIG. 1 is a longitudinal cross-sectional view of a centrifugal compressor according to an embodiment of the present invention.

FIG. 1 is a view showing a schematic configuration of a centrifugal compressor 100, which is the rotating machine of the embodiment.

As shown in FIG. 1, a rotary shaft 5 is axially supported at a casing 105 of the centrifugal compressor 100 via a journal bearing 105*a* and a thrust bearing 105*b*. The rotary shaft 5 can be rotated around an axis O, and a plurality of impellers 10 are attached thereto arranged in the axis O direction.

The impeller 10 gradually compresses a gas G supplied from a flow path 104 of an upstream side formed at the casing 105 using centrifugal force by rotation of the rotary shaft 5 to cause the gas G to flow to the flow path 104 of a downstream side.

A suction port 105*c* configured to introduce the gas G from the outside is formed at the casing 105 at a front side (a left side of FIG. 1) in the axis O direction of the rotary shaft 5. In addition, a discharge port 105*d* configured to discharge the gas G to the outside is formed at a rear side (a right side of FIG. 1) in the axis O direction. In addition, in the following description, a left side of the drawings is referred to as a "front side" and a right side of the drawings is referred to as a "rear side."

When the rotary shaft 5 is rotated by the configuration of the centrifugal compressor 100, the gas G from the suction port 105*c* is introduced into the flow path 104, and the gas G is gradually compressed by the impeller 10 and then discharged from the discharge port 105*d*. Further, while FIG. 1 exemplarily shows six impellers 10 serially installed at the rotary shaft 5, at least one impeller 10 may be installed with respect to the rotary shaft 5. In the following description, for simplicity of description, the case in which one impeller 10 is installed at the rotary shaft 5 is exemplarily described.

Figure 2:
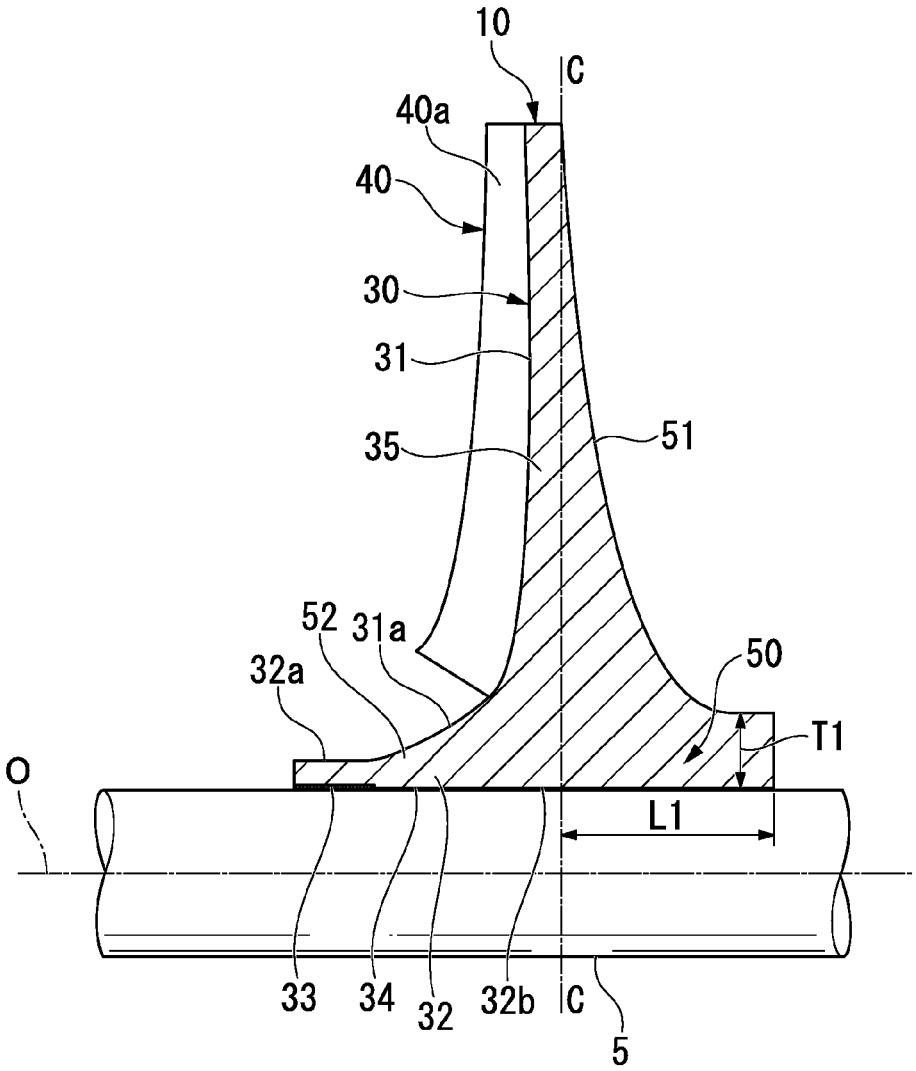
FIG. 2 is a longitudinal cross-sectional view of an impeller according to a first embodiment of the present invention.

As shown in FIG. 2, the impeller 10 of the centrifugal compressor 100 includes a disk section 30 fixed with respect to the rotary shaft 5 through shrinkage fitting, and a plurality of blade sections 40 provided to protrude from the front surface 31 in the axis O direction of the disk section 30. The impeller 10 of the centrifugal compressor 100 is an open type impeller.

The disk section 30 includes a tube section 32 fitted onto the rotary shaft 5 and having a substantially cylindrical shape. The tube section 32 includes a grip section 33 installed at a front side, which is one side in the axis O direction, and fixed to the outer circumferential surface of the rotary shaft 5, and a non-grip section 34 installed at a rear side, which becomes closer to the other side in the axis O direction than the grip section 33, having a slightly larger diameter than the outer diameter of the rotary shaft 5, and configured to form a gap between the non-grip section 34 and the outer circumferential surface of the rotary shaft 5. The grip section 33 has a smaller diameter than the rotary shaft 5 in the state not fixed to the rotary shaft 5, and is fixed to the rotary shaft 5 by shrinkage fitting.

Further, the disk section 30 includes a disk main body section 35 having a substantially circular plate shape, disposed closer to the other side in the axis O direction than the grip section 33, and extending outward from the non-grip section 34 of the tube section 32 in a radial direction.

The disk main body section 35 becomes thicker as it goes inward in the radial direction. In addition, the disk section 30 includes the front surface 31, and a curved surface 31*a* having a concave shape and smoothly connected to an outer circumferential surface 32*a* of the tube section 32.

The pluralities of blade sections 40 are disposed in the circumferential direction of the disk main body section 35 at equal intervals. These blade sections 40 have a substantially constant plate thickness, and are formed into slightly tapered shape toward the outside in the radial direction when seen in a side view. In addition, these blade sections 40 are formed to protrude from the front surface 31 of the disk section 30 toward a front side in the axis O direction. Further, the above-mentioned flow path 104 is formed by the front surface 31, the curved surface 31*a*, the outer circumferential surface 32*a*, surfaces 40*a* of the blade section 40 opposite to each other in the circumferential direction, and wall surfaces of the casing 105 opposite to the front surface 31 and the curved surface 31*a*, at a disposition point of the impeller 10.

The above-mentioned disk section 30 includes a hoop stress suppression section 50 disposed closer to a rear side opposite to the front side in the axis O direction than the disk main body section 35. The hoop stress suppression section 50 is formed to extend from the tube section 32 to the rear side in the axis O direction. Here, in FIG. 3, a position of the rearmost side in the axis O direction of the disk main body section 35 is shown by line C-C. A portion formed closer to the rear side in the axis O direction than the line C-C is the hoop stress suppression section 50.

The hoop stress suppression section 50 has a thickness gradually reduced toward the rear side in the axis O direction to a position at which the thickness becomes a predetermined thickness T1 in the radial direction, from the outside in the radial direction of the disk section 30 toward the inside in the radial direction. Accordingly, the hoop stress suppression section 50 has a rear surface 51 in the axis O direction having a curved surface with a concave shape. Here, a length L1 in the axis O direction or the thickness T1 in the radial direction of the hoop stress suppression section 50 may be set to a minimum value of the length L1 or the thickness T1 based on a maximum value of a revolution number of the rotary shaft 5 (a maximum value of the applied hoop stress) and necessary strength of the impeller 10 from a viewpoint of reduction in weight. Further, as the value of the thickness T1 is increased, the maximum value of the hoop stress applied to the impeller 10 is reduced.

Figure 3:
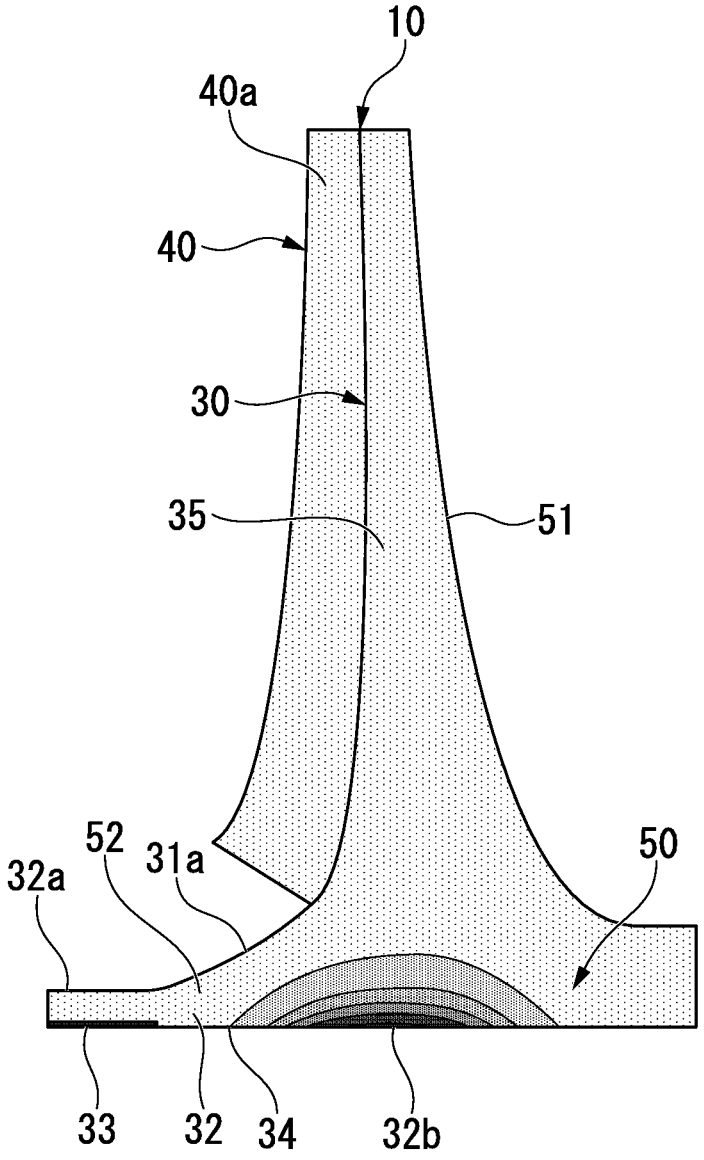
FIG. 3 is a view showing a simulation result of the impeller.

FIG. 3 is a contour diagram showing a simulation result of stress distribution upon high speed rotation in the impeller 10 of the embodiment. Further, in FIG. 3, the point to which a larger stress is applied is represented with thicker shading (also similar in FIG. 6).

Figure 14:
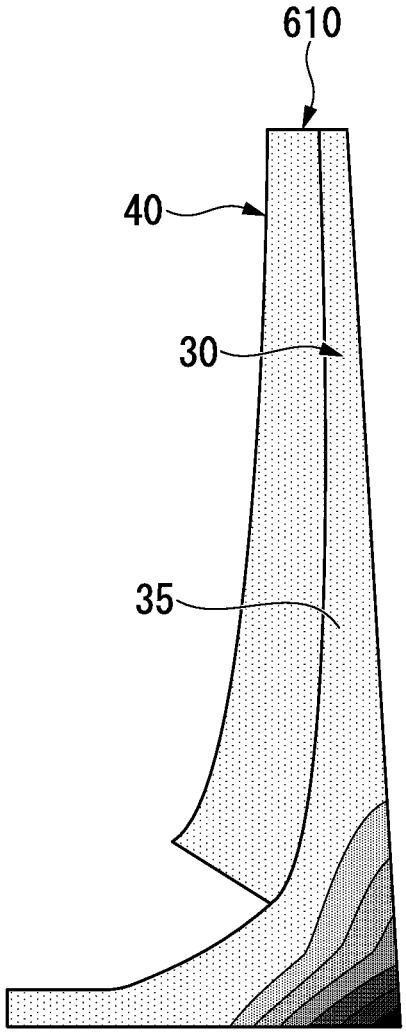
FIG. 14 is a view corresponding to FIG. 3 of an impeller of the related art.
Figure 15:
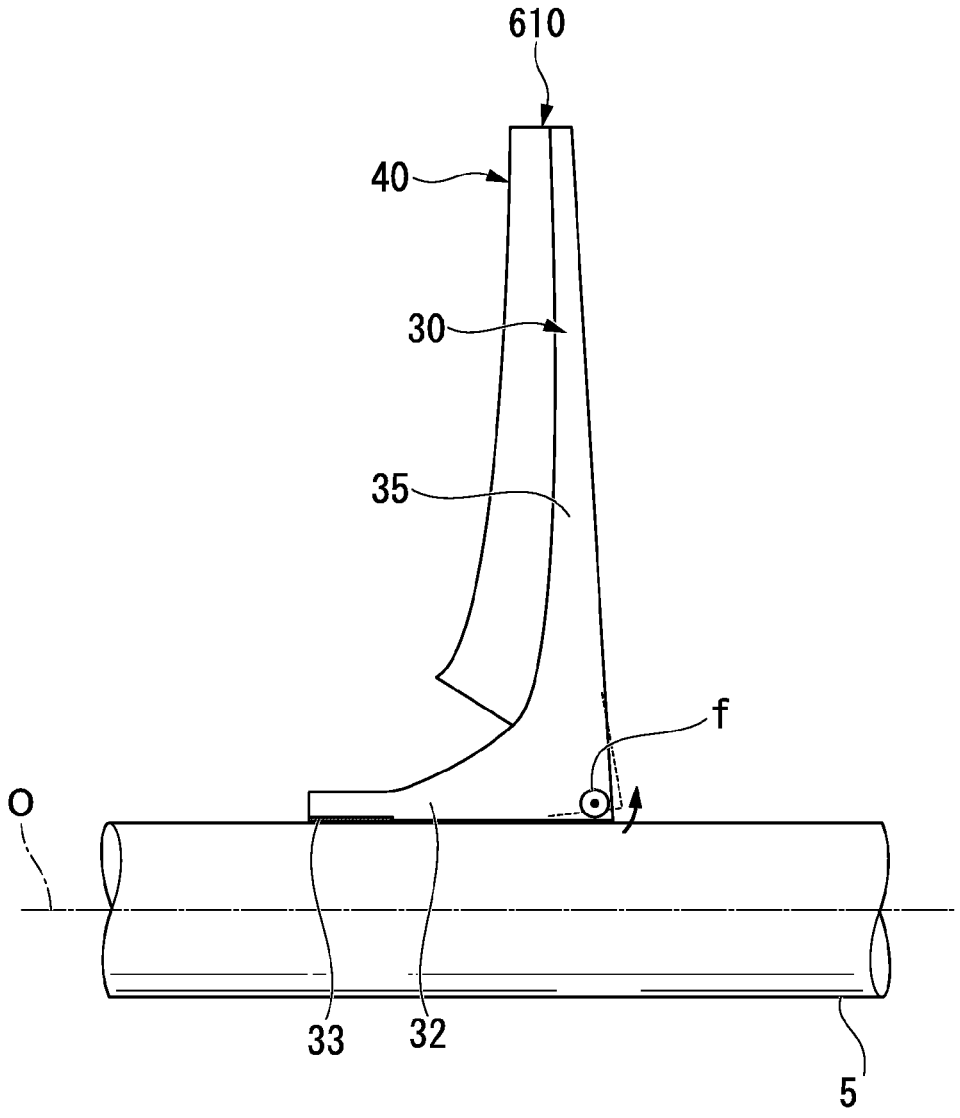
FIG. 15 is a view for describing a hoop stress in the impeller of the related art.

As shown in FIG. 3, in the case of the impeller 10 including the hoop stress suppression section 50, a range in which the stress applied upon rotation extends in the axis O direction than in the case of an impeller (see FIG. 14) that does not include the hoop stress suppression section 50. However, the maximum value thereof is reduced.

This is because, as stiffness of the tube section 32 in the radial direction due to a centrifugal force is increased by the hoop stress suppression section 50, the impeller 10 can be suppressed from being deformed to float in the radial direction at the other side in the axis O direction, and thus an increase in hoop stress caused by deformation in the radial direction of the impeller 10 can be suppressed.

In addition, in the impeller 10, the dimension of a member in the radial direction of an inclined section 52 between the grip section 33 and the disk main body section 35 may be set to an appropriate dimension of a member in which a sufficient stiffness is obtained in the axis O direction. As a result, even at the front side opposite to the hoop stress suppression section 50 in the axis O direction in which the grip section 33 is installed, deformation in the radial direction of the tube section 32 can be suppressed, and it is possible to contribute to reduction in hoop stress.

Accordingly, according to the impeller of the above-mentioned first embodiment, the maximum value of the hoop stress applied to the tube section 32 can be reduced. As a result, the point fixed to the rotary shaft 5 can be easily attached and detached with respect to the rotary shaft 5 by only fixing the grip section 33 of the front side in the axis O direction, and local concentration of the stress upon rotation can be prevented.

Next, an impeller 210 according to a second embodiment of the present invention and the impeller 210 will be described with reference to the accompanying drawings. Note that, the impeller 210 of the second embodiment is distinguished from the impeller 10 of the above-mentioned first embodiment in that a function of separating a hoop stress and an axial direction stress is further provided. For this reason, the same portions as in the above-mentioned first embodiment are designated by the same reference numerals.

First, based on FIG. 4, a hoop stress and an axial direction stress applied to the impeller 10 of the above-mentioned first embodiment will be described.

Figure 4:
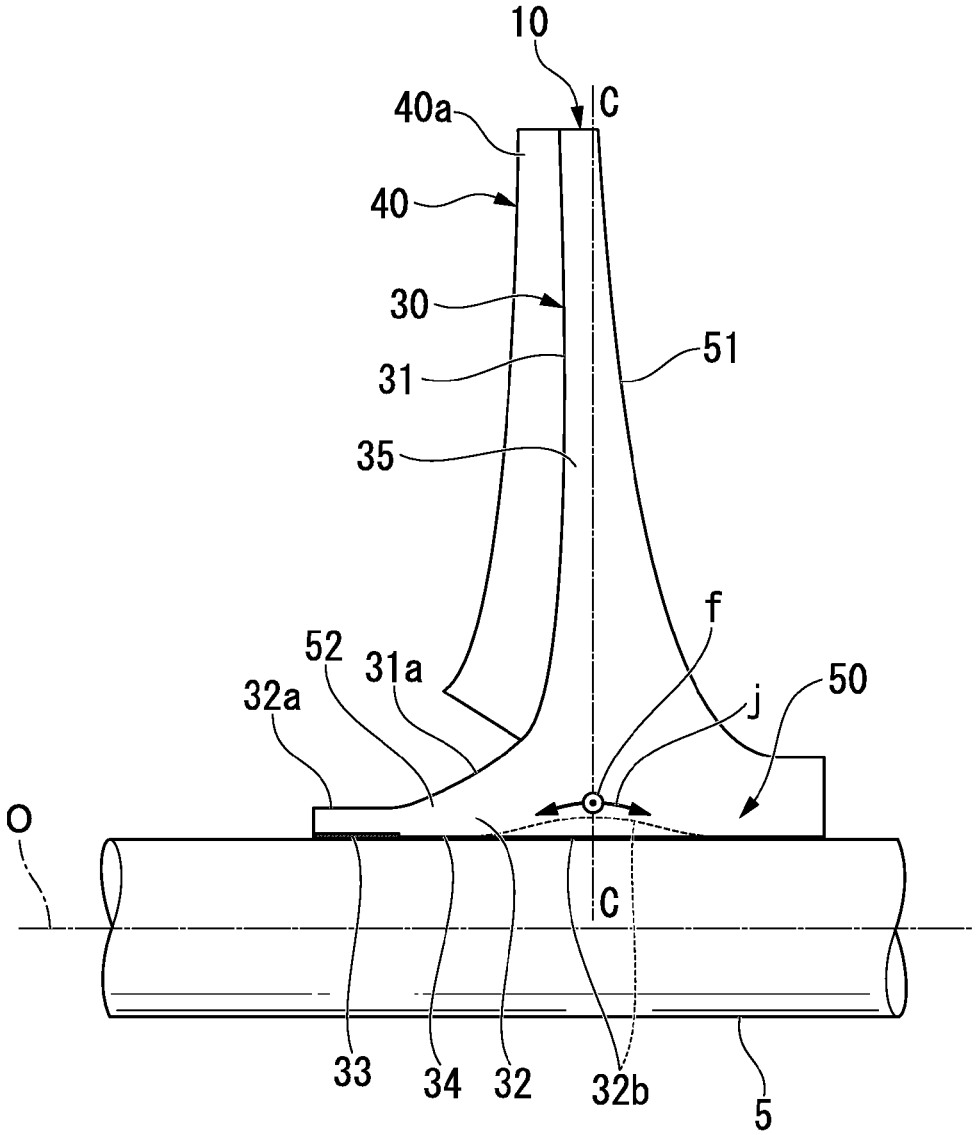
FIG. 4 is a view for describing a hoop stress and an axial direction stress of the impeller.

As shown in FIG. 4, in the impeller 10, while the hoop stress is evenly distributed by the hoop stress suppression section 50, the hoop stress is concentrated on an inner diameter section 32*b* of the disk main body section 35 disposed inside in the radial direction. Further, in FIG. 4, a point at which the hoop stress is maximally concentrated is referred to by reference numeral "f."

Further, even in the impeller 10, upon rotation of the rotary shaft 5, since the inner diameter section 32*b* is to be displaced outward in a centrifugal direction (the radial direction), the inner diameter section 32*b* is curved to float outward from the rotary shaft 5 in the radial direction (shown by a broken line in FIG. 4). In addition, a thrust force from a fluid is applied to the impeller 10. Then, an axial direction stress, which is a force pulling in both directions which is one side and the other side in the axis O direction, is applied by curved deformation due to the centrifugal force and deformation in the axial direction due to the thrust force.

Then, stress concentration occurs due to overlapping of the stress in the axis O direction and the hoop stress.

Further, in FIG. 4, the axial direction stress is represented by an arrow j. In addition, in FIG. 4, deformation of the inner diameter section 32*b* is exaggerated for clarity.

Figure 5:
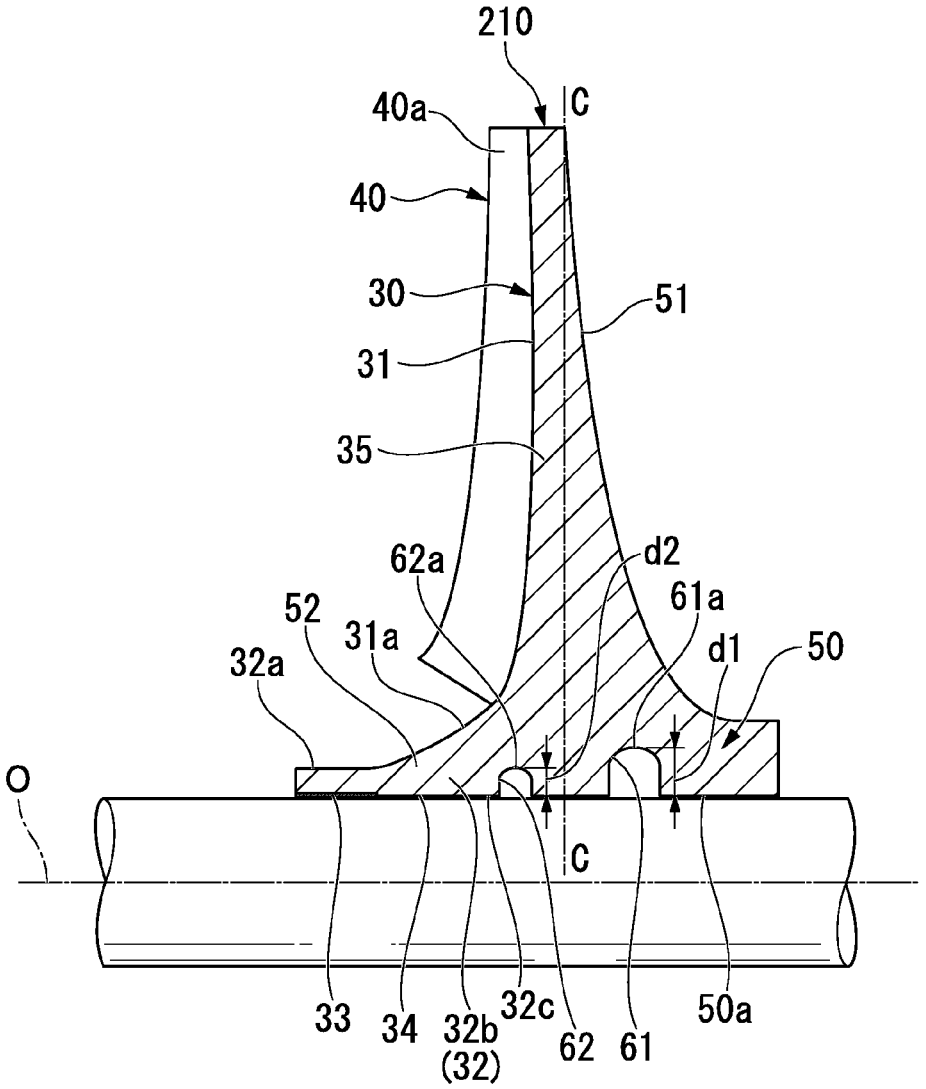
FIG. 5 is a longitudinal cross-sectional view corresponding to FIG. 2 according to a second embodiment of the present invention.

As shown in FIG. 5, the impeller 210 of the second embodiment is an open type impeller having the disk section 30 and the blade section 40, similar to the impeller 10 of the above-mentioned first embodiment. The disk section 30 includes the disk main body section 35 and the tube section 32.

The disk main body section 35 has a substantially circular plate shape extending from the non-grip section 34 toward the outside in the radial direction. The disk main body section 35 has a thickness increased as it goes toward the inside in the radial direction. In addition, the disk section 30 includes the front surface 31, and the curved surface 31*a* having a concave shape and configured to be smoothly connected to the outer circumferential surface 32*a* of the tube section 32. The blade section 40 is configured to be similar to the above-mentioned first embodiment, and is formed to protrude from the front surface 31.

The above-mentioned disk section 30 includes the hoop stress suppression section 50 disposed closer to the rear side in the axis O direction than the disk main body section 35. The hoop stress suppression section 50 is formed to extend such that the tube section 32 extends toward the rear side in the axis O direction.

In addition, the tube section 32 and the hoop stress suppression section 50 include a first groove (a first axial direction stress displacement groove) 61 and a second groove (a second axial direction stress displacement groove) 62 formed at inner circumferential surfaces 32*c* and 50*a* and having an annular shape about the axis O. That is, the first groove 61 is disposed closer to the rear side in the axis O direction than the line C-C. Further the second groove 62 is spaced a predetermined interval from the first groove 61 and disposed closer to the front side in the axis O direction than the line C-C.

In general, the centrifugal force upon rotation has a maximum value on or around the line C-C. For this reason, as shown in FIG. 4, the hoop stress has a maximum stress at a point at which the line C-C and the innermost diameter section of the non-grip section 34 cross each other or therearound. Further upon rotation, the axial direction stress is also generated based on a load in a thrust direction (a thrust force) generated by a gas pressure difference between a flow path side and a disk rear surface side. When the grooves (the first groove 61 and the second groove 62) are formed like in the embodiment, the thrust force has a high value around the groove. For example, when a portion of the groove is a round groove having an arc shape like in the embodiment, the axial direction stress has a maximum value at the deepest section of the groove, which is a peak of the arc. For this reason, the axial direction stress in the embodiment has a maximum stress in a direction connecting the deepest section 61*a* of the first groove 61 and the deepest section 62*a* of the second groove 62. In this way, as the first groove 61 and the second groove 62 are formed, the point at which the axial direction stress is maximized can be displaced outward in the radial direction farther than in the first embodiment. As a result, the concentrated point of the axial direction stress can be separated from the concentrated point of the hoop stress.

Figure 6:
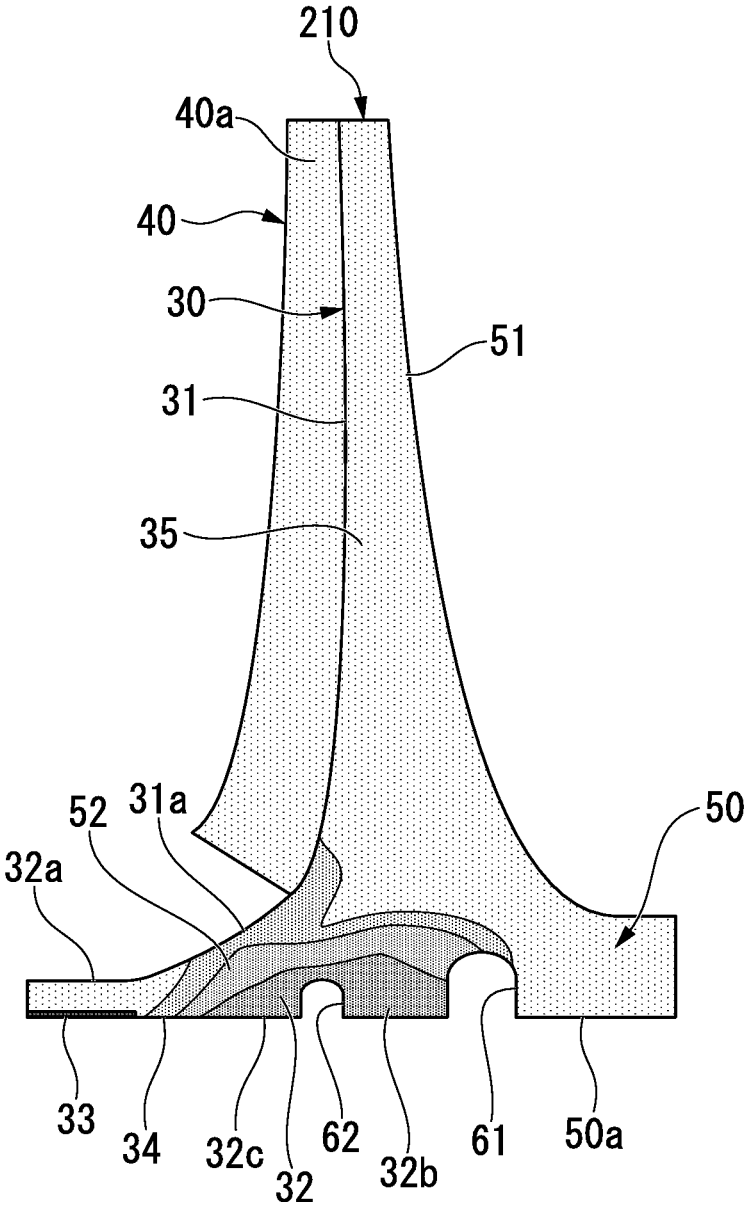
FIG. 6 is a view showing a simulation result of the impeller.

FIG. 6 is a contour diagram showing a simulation result of stress distribution upon high speed rotation in the impeller 210 of the embodiment.

The stress applied to the impeller 210 is obtained by overlapping the hoop stress and the axial direction stress. As shown in FIG. 6, when the concentrated point of the axial direction stress is separated from the concentrated point of the hoop stress (see FIG. 7), the maximum value of the stress applied upon rotation is reduced in comparison with the case in which the concentrated points are not separated. In this way, as the first groove 61 and the second groove 62 are formed, the local concentration of the stress upon rotation can be suppressed more than in the impeller 10 of the first embodiment.

Figure 7:
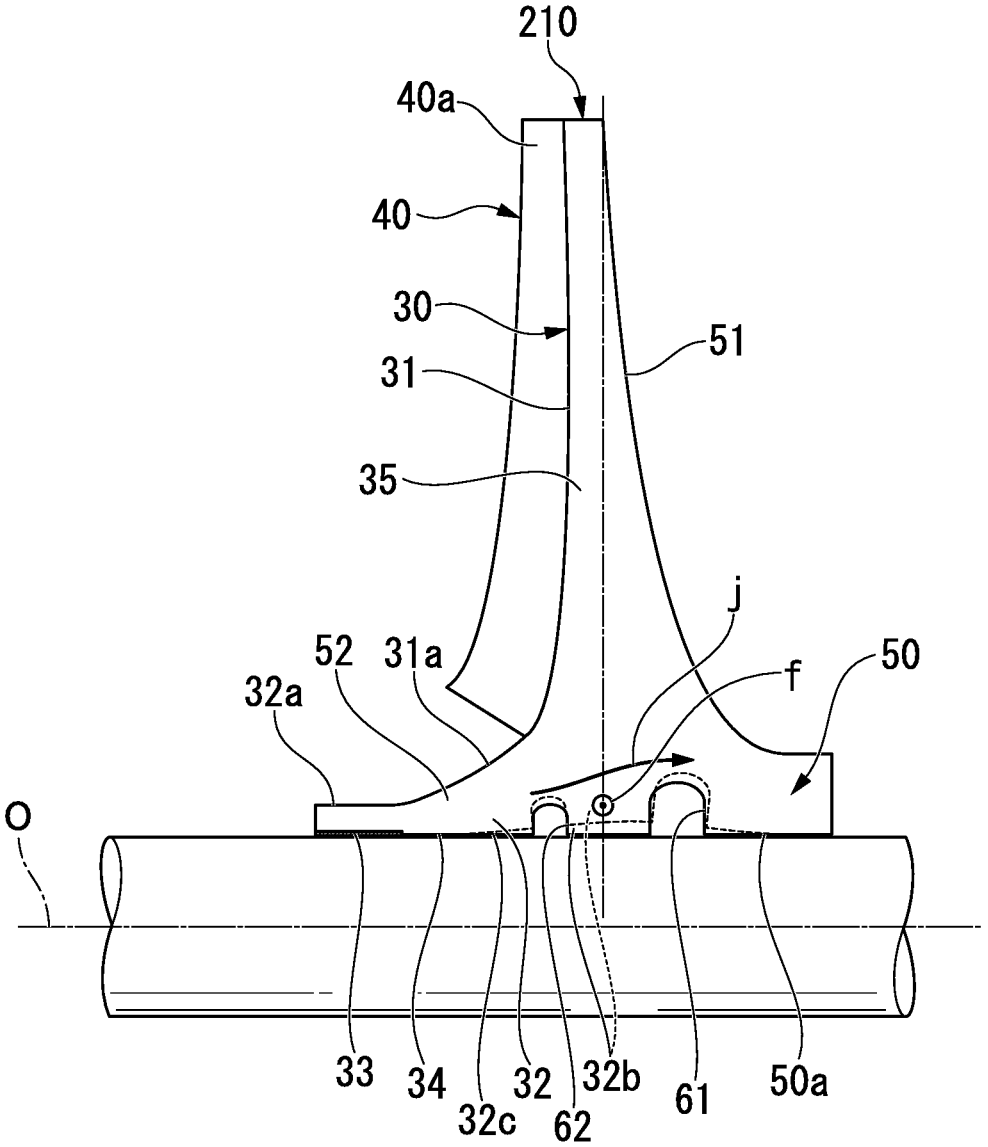
FIG. 7 is a view for describing a hoop stress and an axial direction stress of the impeller.

As a result, the stress concentration in the disk section 30 can be reduced, and especially, deformation upon high speed rotation of the impeller 210 can be suppressed. In FIG. 7, a displacement concept of the impeller 210 upon rotation is shown by a broken line.

Further, FIG. 5 shows the case in which a groove depth d1 of the first groove 61 is larger than a groove depth d2 of the second groove 62. However, the present invention is not limited to a relative amount of both of the groove depths d1 and d2. In addition, the present invention is not limited to widths of the first groove 61 and the second groove 62, a distance between the first groove 61 and the second groove 62, or the like. This may be similarly established when separation of the concentrated point of the hoop stress and the concentrated point of the axial direction stress can be set to be significantly performed. The groove depth d1 of the first groove 61 and the profile of the second groove 62 may be set such that sufficient strength of the impeller 210 upon rotation can be secured.

In addition, in the embodiment, while the case in which portions of the first groove 61 and the second groove 62 have round grooves having an arc-shaped cross-section has been described, the present invention is not limited thereto. For example, a square groove or the like may be used.

Figure 8A:
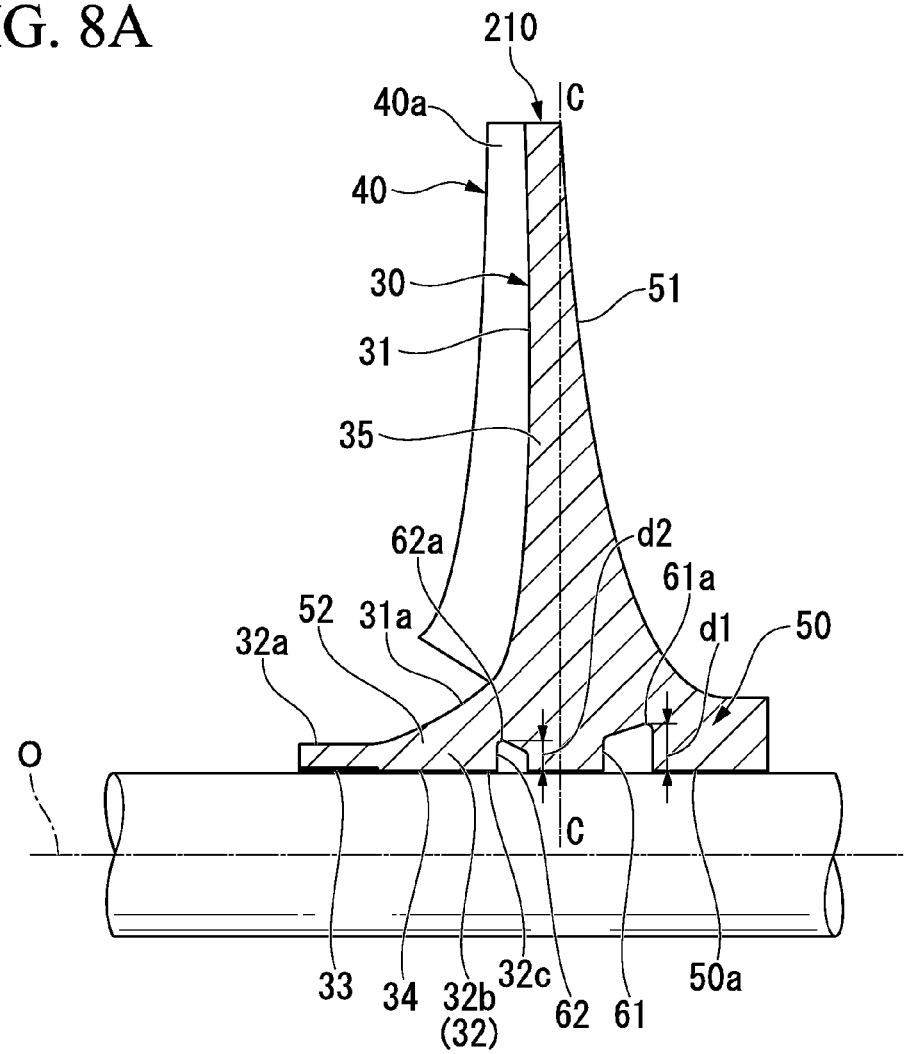
FIG. 8A is a longitudinal cross-sectional view corresponding to FIG. 2 according to a first modified example of the second embodiment.
Figure 8B:
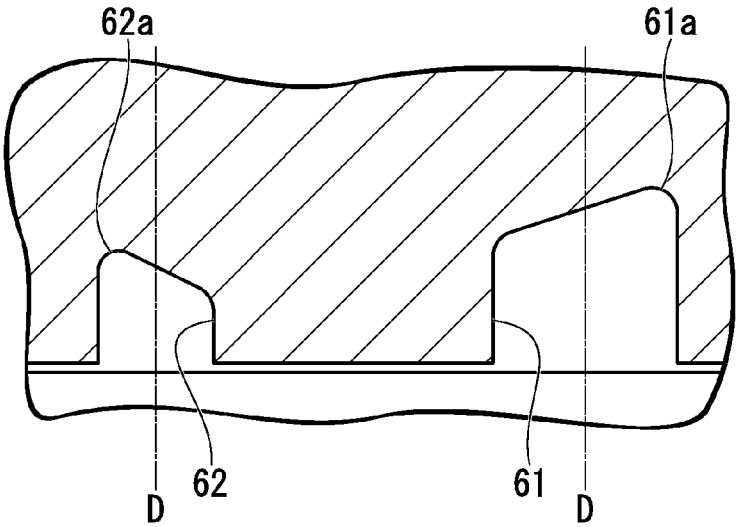
FIG. 8B is a partially enlarged view of FIG. 8A.

In addition, while the case in which the first groove 61 and the second groove 62 have symmetrical shapes with respect to a reference surface perpendicular to the axis O direction has been shown, the present invention is not limited thereto. As a first modified example, for example, as shown in FIGS. 8A and 8B, this is established even when the first groove 61 and the second groove 62 have asymmetrical shapes with respect to the reference surface perpendicular to the axis O direction (a reference surface D in FIG. 8B). Even in this case, the axial direction stress has a maximum value at a deepest section 61*a* of the first groove 61 and a deepest section 62*a* of the second groove 62. This is effective when a groove width is large and the impeller strength upon rotation cannot be sufficiently secured, and particularly, when the concentrated point of the axial direction stress is maximally separated from the concentrated point of the hoop stress.

Further, the embodiment shows the case in which the first groove 61 is disposed closer to the rear side in the axis O direction than the line C-C, and the second groove 62 is spaced a predetermined interval from the first groove 61 and disposed closer to the front side in the axis O direction than the line C-C. In general, this is because the hoop stress is concentrated on the line C-C or therearound. This is because the line C-C is disposed at the rearmost side in the axis O direction of the disk main body section 35 and the centrifugal force is in proportion to a radius. However, the concentrated point of the hoop stress may be generated at a point other than the line C-C according to the shape of the impeller and weight distribution in the impeller. In this case, regardless of the position of the line C-C, the first groove 61 may be disposed closer to the rear side than the concentrated point of the hoop stress, the second groove 62 may be spaced the predetermined interval from the first groove 61 and disposed closer to the front side in the axis O direction than the concentrated point of the hoop stress, and in the inner circumferential surface continuing to at least the tube section 32 and the hoop stress suppression section 50, the first groove 61 may be disposed in the axis O direction at one side in the axis O direction of the concentrated point of the hoop stress and the second groove 62 may be formed at the other side in the axis O direction.

Further, the present invention is not limited to the configuration of the above-mentioned embodiment, and design changes may be made without departing from the scope of the present invention.

Figure 9:
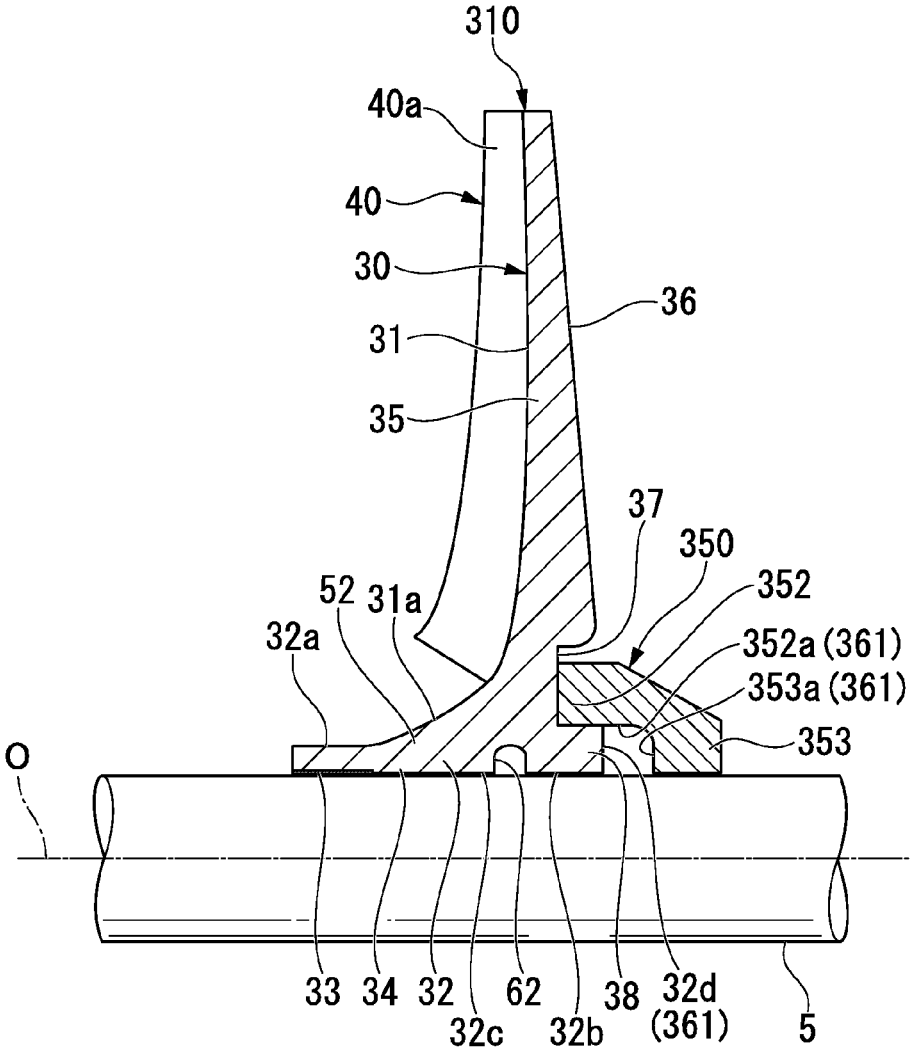
FIG. 9 is a longitudinal cross-sectional view corresponding to FIG. 2 according to a second modified example of the second embodiment.

For example, as a second modified example of the above-mentioned second embodiment, like an impeller 310 shown in FIG. 9, a hoop stress suppression section 350 may be installed separately with respect to the tube section 32 and the disk main body section 35. In the case of the second modified example shown in FIG. 9, an annular concave section 37 is formed at a rear surface 36 in the axis O direction of the disk section 30 when seen from the rear side thereof. Here, the hoop stress suppression section 350 includes a tubular section 352 fixed to a tubular section 38 inside in the radial direction of the concave section 37 by shrinkage fitting, and a bent section 353 disposed at the rear side in the axis O direction of the tubular section 352 and bent inward in the radial direction. In this case, a first groove 361 having the same function as the above-mentioned first groove 61 is formed by a front surface 353*a* of the bent section 353, a rear surface 32*d* of the tube section 32 and an inner circumferential surface 352*a* of the tubular section 352.

By forming as a second modified example, since a material having a high Young's modulus can be used as a material of the hoop stress suppression section 350, the hoop stress suppression section 350 cannot be easily deformed in comparison with the disk section 30. Further, while FIG. 9 shows an example in which the corners of the tubular section 352 and the bent section 353 are chamfered to reduce the weight thereof, the chamfering may be omitted.

Figure 10:
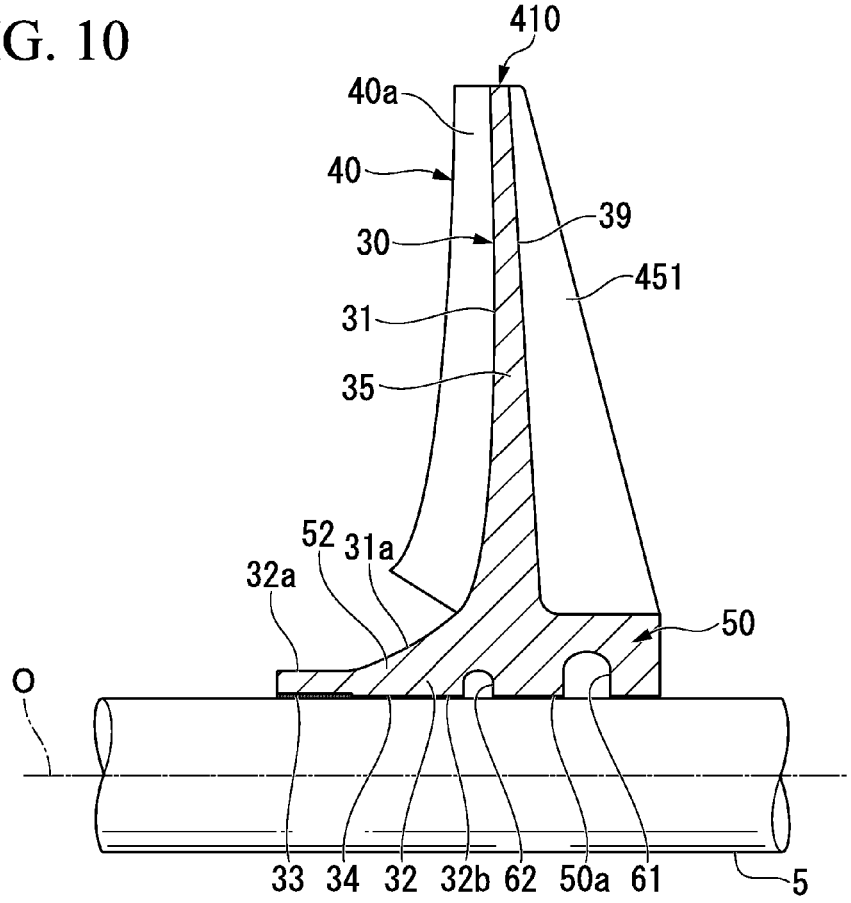
FIG. 10 is a longitudinal cross-sectional view corresponding to FIG. 2 according to a third modified example of the second embodiment.
Figure 11:
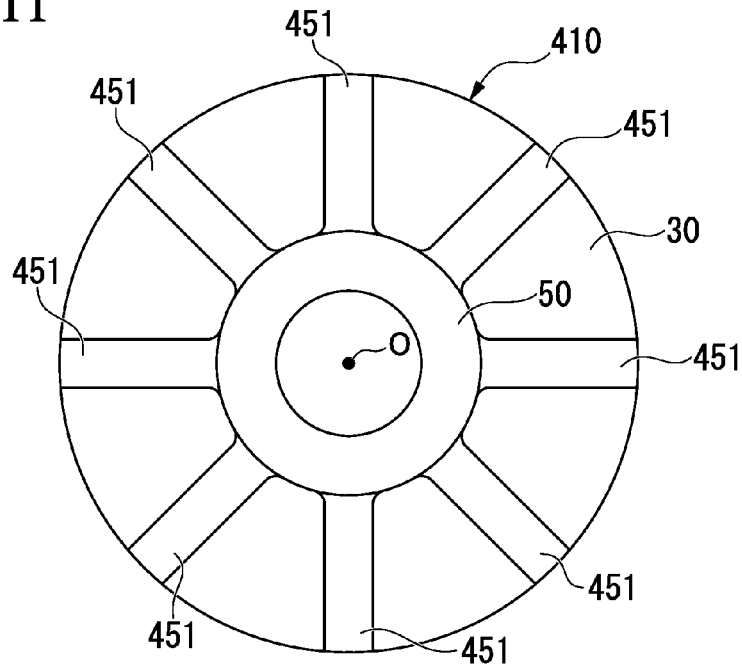
FIG. 11 is a side view when seen from a rear side in an axial direction of the third modified example.

In addition, for example, like an impeller 410 shown in FIGS. 10 and 11 as a third modified example of the above-mentioned second embodiment, the rear surface 51 (see FIG. 2) of the hoop stress suppression section 50 may be replaced with ribs 451 radially formed at predetermined intervals when seen from the rear side in the axis O direction. The ribs 451 are formed throughout a rear surface 39 in the axis O direction of the disk main body section 35 and the hoop stress suppression section 50. When formed as described above, generation of the local stress concentration due to overlapping of the point at which the hoop stress is concentrated and the point at which the axial direction stress is concentrated can be prevented, and the weight of the disk section 30 can be reduced while suppressing a decrease in stiffness of the disk section 30. As a result, improvement of response of control of a revolution number, reduction in torque of starting of rotation, and stabilization of a shaft system can be accomplished.

Figure 12:
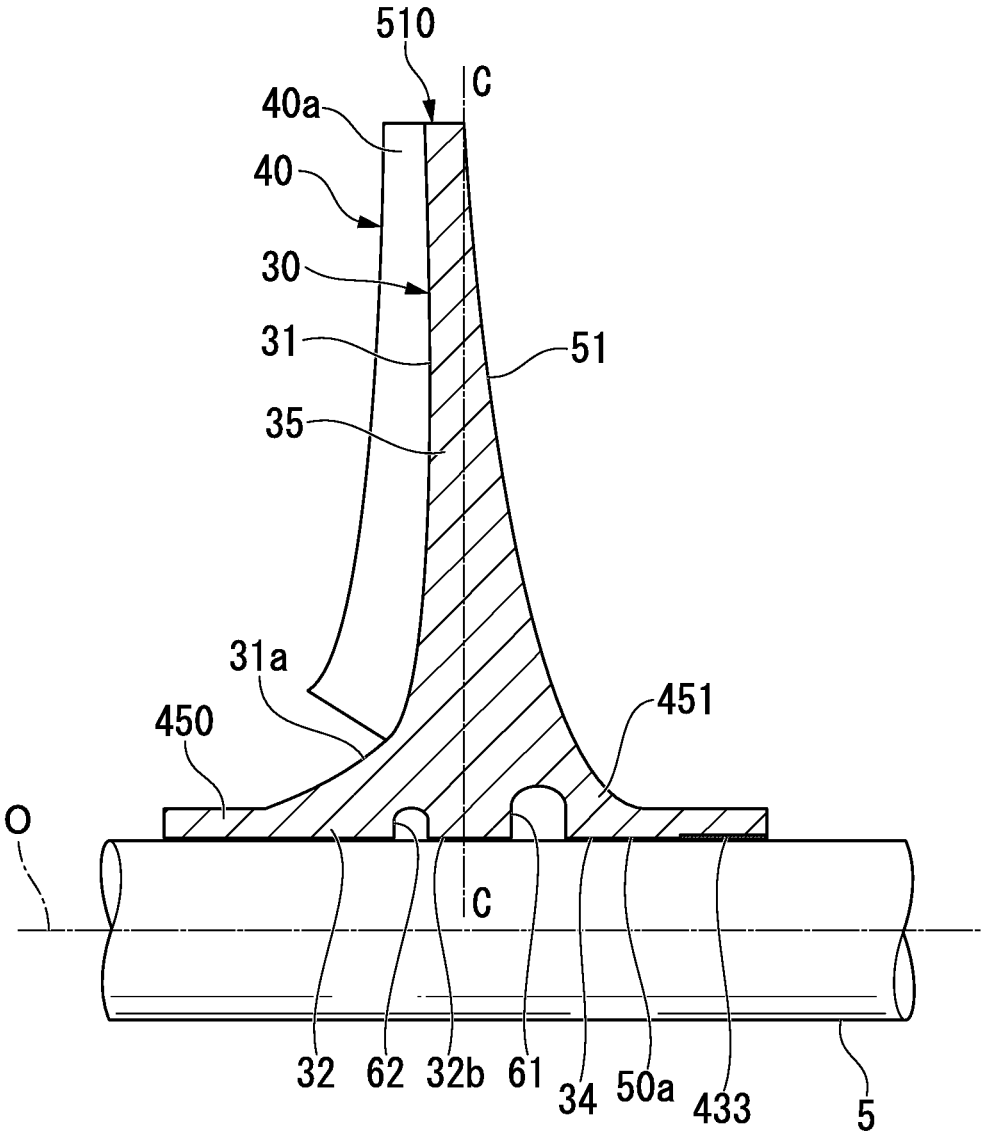
FIG. 12 is a longitudinal cross-sectional view corresponding to FIG. 2 according to a fourth modified example of the second embodiment.

In addition, in the above-mentioned second embodiment, while the case in which the grip section 33 (one side portion) is disposed at the front side in the axis O direction of the tube section 32 has been described, for example, like an impeller 510 shown in FIG. 12 as a fourth modified example of the above-mentioned second embodiment, a grip section 433 shrinkage-fitted to the rotary shaft 5 may be formed at the rear side as one side in the axis O direction of the disk main body 35. Then, a hoop stress suppression section 450 is formed at the front side as the other side in the axis O direction, which becomes an opposite side of the grip section 433 with respect to the disk main body 35. In this case, the point at which the hoop stress is concentrated is the foremost side in the axis O direction of the disk main body section 35 or therearound. Then, as the impeller 510 of the fourth modified example includes the hoop stress suppression section 450 disposed at the front side in the axis O direction opposite to the grip section 433 in the axis O direction and having the tube section 33 extending to the front side in the axis O direction, concentration of the hoop stress can be prevented by the hoop stress suppression section 450.

Figure 13:
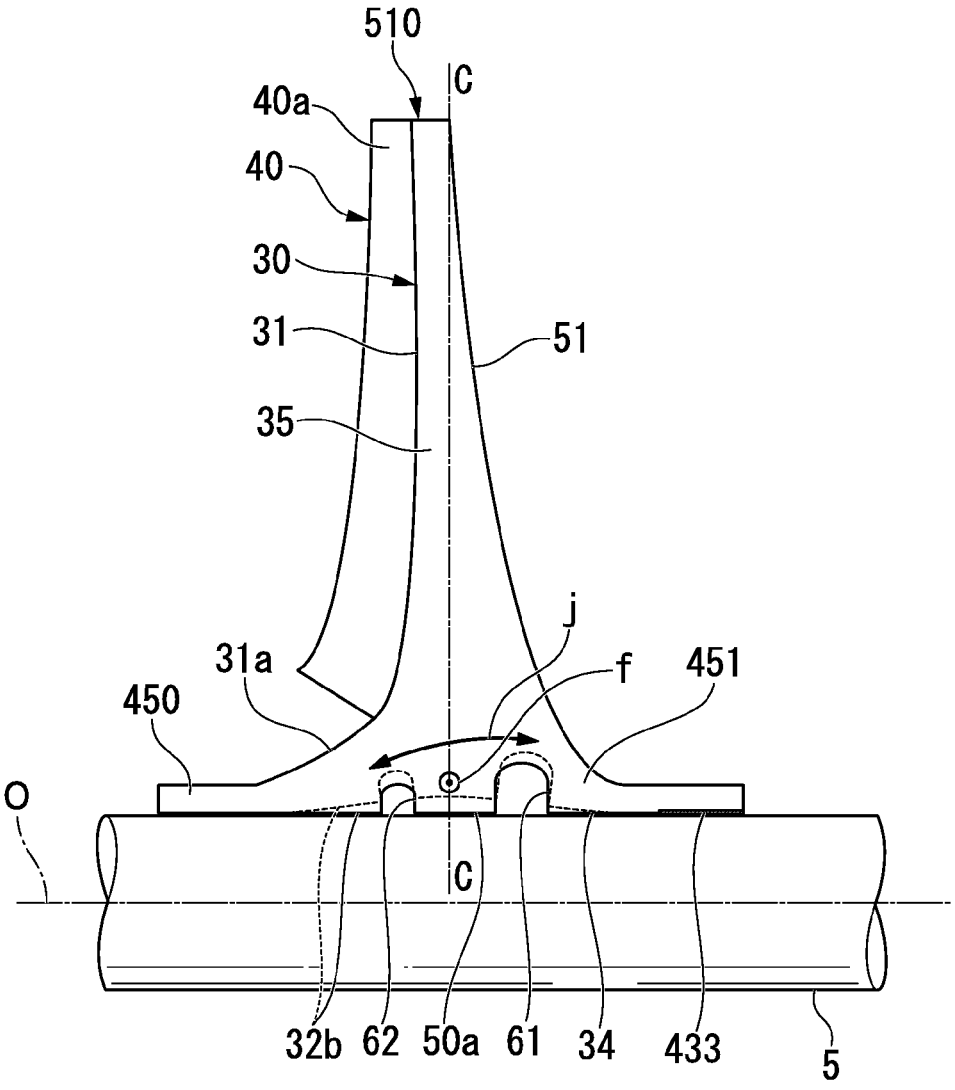
FIG. 13 is a view for describing the impeller corresponding to FIG. 7 according to the fourth modified example.

Then, even in the case of the fourth modified example, the first groove 61 and the second groove 62 are formed. As shown in FIG. 13, as the first groove 61 and the second groove 62 are formed, like the second embodiment, upon rotation, the point at which the hoop stress is concentrated and the point at which the axial direction stress is concentrated are separated, and thus local stress concentration can be suppressed.

Here, even in the case of the impeller 510 shown in FIGS. 12 and 13, in the axis O direction, the dimension of a member in a radial direction of the inclined section 451 formed between the grip section 433 and the disk main body section 35 may be set to an appropriate the dimension of a member so that sufficient stiffness is obtained. As a result, since floating of the tube section 32 can be suppressed even at the rear side of the point at which the hoop stress is concentrated, this can contribute to further reduction in hoop stress.

In addition, in the above-mentioned second embodiment, while the example in which the first groove 61 is formed on the rear side in the axis O direction than the line C-C, and the second groove 62 formed on the front side in the axis O direction than the line C-C has been shown, the present invention is not limited thereto. The present invention can also be similarly applied to the case in which a plurality of grooves are formed in at least one of the front side and the rear side in the axis O direction. In this case, similar to the second embodiment, the concentrated point of the hoop stress and the concentrated point of the axial direction stress upon rotation can be separated, the local stress concentration can be suppressed, and thus the weight can be further reduced.

In addition, in the above-mentioned embodiment, while the example in which fixing of the disk section 30 to the rotary shaft 5 is performed by the shrinkage fitting has been described, the present invention is not limited thereto. The grip section may be formed at at least one side in the axis O direction to be fixed to the outer circumferential surface of the rotary shaft 5. In addition, a fixing method using thermal deformation including also shrinkage fitting or freeze fitting is appropriate for the present invention due to easy attachment and detachment by heating or cooling.

In addition, in the above-mentioned embodiment, while the open type impeller having only the disk section 30 and the blade section 40 has been exemplarily described, the present invention is not limited thereto. The present invention can also be applied to a closed type impeller further having a portion of a cover with respect to the disk section 30 and the blade section 40.

Further, in the above-mentioned embodiment, while an example of the centrifugal compressor 100 serving as a rotating machine has been described, the present invention is not limited to the centrifugal compressor 100, and for example, the impeller of the present invention can also be applied to various industrial compressors, turbo freezing machines, and small gas turbines.

INDUSTRIAL APPLICABILITY

According to the impeller, local concentration of the stress upon rotation can be prevented while enabling easy attachment and detachment with respect to the rotary shaft.

REFERENCE SIGNS LIST

100 centrifugal compressor (rotating machine)
5 rotary shaft

30 disk section
31 front surface
32 tube section
32*c* inner circumferential surface
33, 433 grip section (one side section)
35 disk main body section
39 rear surface
40 blade section
50 hoop stress suppression section
50*a* inner circumferential surface
61 first groove (first axial direction stress displacement groove)
62 second groove (second axial direction stress displacement groove)
O axis

The invention claimed is:

1. An impeller comprising:

a disk section comprising:

a tube section having a substantially tube shape, into which a rotary shaft rotated around an axis is inserted, and provided with a grip section installed at a first side in an axial direction of the rotary shaft and fixed to the rotary shaft;

a disk main body section formed closer to a second side in the axial direction, which is opposite to the first side, than the grip section and extending from the tube section toward an outside in a radial direction of the rotary shaft; and a hoop stress suppression section extending from the tube section to be closer to the second side in the axial direction than the disk main body section; and a blade section protruding from the disk main body section in the axial direction, wherein the disk section is provided with a first axial direction stress displacement groove and a second axial direction stress displacement groove formed on an inner circumferential surface of the tube section or the hoop stress suppression section, one of the first and second axial direction stress displacement grooves being formed closer to the first side in the axial direction than a position at which a hoop stress is maximally concentrated and another of the first and second axial direction stress displacement grooves being formed closer to the second side in the axial direction than the position at which the hoop stress is maximally concentrated, and the first and second axial direction stress displacement grooves being configured to displace a position at which an axial direction stress applied to the disk section is concentrated toward the outside in the radial direction from the position at which the hoop stress is concentrated, wherein a groove depth of the first axial direction stress displacement groove is larger than a groove depth of the second axial direction stress displacement groove, wherein the first axial direction stress displacement groove and the second axial direction stress displacement groove are rounded grooves each having an arc-shaped cross-section that is symmetrical with respect to a reference surface perpendicular to the axial direction and such that a deepest section of each of the first axial direction stress displacement groove and the second axial direction stress displacement groove is a peak of the arc-shaped cross-section, and wherein the deepest section is located at an outermost side in the radial direction of each of the first or second axial direction stress displacement grooves.

2. The impeller according to claim 1, wherein the disk section includes the hoop stress suppression section as a separate member from the tube section and the disk main body section, and the hoop stress suppression section is formed of a material having a higher Young's modulus than the disk main body section.

3. The impeller according to claim 1, wherein a rib is provided throughout the disk main body section and the hoop stress suppression section.

4. A rotating machine comprising the impeller according to claim 1.

5. The impeller according to claim 1, wherein the disk section is provided with a plurality of at least one of the first axial direction stress displacement groove and the second axial direction stress displacement groove which are formed in at least one of a front side and a rear side in the axial direction with respect to a position of a rearmost side in the axial direction of the disk main body section.

* * * * *